US005727493A

United States Patent [19]

Pierce

[11] Patent Number: 5,727,493

[45] Date of Patent: Mar. 17, 1998

[54] BOAT BUMPER

[76] Inventor: Richard C. Pierce, HC1, Box 128, Stratton, Nebr. 69043

[21] Appl. No.: 805,976

[22] Filed: Feb. 26, 1997

[51] Int. Cl.[6] ..... B63B 59/02

[52] U.S. Cl. ..... 114/219; 114/343; D12/168; D12/317

[58] Field of Search ..... 114/219, 343; D12/168, 317

[56] References Cited

U.S. PATENT DOCUMENTS

| | | | |
|---|---|---|---|
| D. 29,635 | 11/1898 | Gravier | D12/168 |
| D. 318,839 | 8/1991 | Glenn et al. | D12/317 |
| 4,277,055 | 7/1981 | Yamaguchi et al. | 267/140 |
| 4,611,552 | 9/1986 | Koppelomaki | 114/343 |
| 4,667,619 | 5/1987 | Nishida | 114/361 |
| 4,751,891 | 6/1988 | Wilson | 114/219 |
| 4,762,080 | 8/1988 | Pearson | 114/219 |
| 4,815,412 | 3/1989 | Cassaro, Jr. | 114/343 |
| 4,909,172 | 3/1990 | Hamby | 114/219 |
| 4,962,719 | 10/1990 | Hughes et al. | 114/343 |
| 5,357,890 | 10/1994 | Mason, Jr. et al. | 114/219 |

*Primary Examiner*—Ed L. Swinehart

*Attorney, Agent, or Firm*—Zarley, McKee, Thomte Voorhees & Sease; Mark D. Frederiksen

[57] ABSTRACT

A boat bumper includes an elongated pipe encased in an injection molded material and having a pair of elongated spaced apart pads affixed to a rearward side of the body. Each pad has a generally V-shaped notch formed therein for receiving the bow edge of a boat. A bracket has a head portion extending around the pipe and is located between the two pads, the bracket having a pair of legs projecting rearwardly outwardly through the casing, to receive the eye on the bow of a boat therebetween. A ring is mounted on the bracket and projects diametric to the legs through the casing and forwardly from the body. The casing is formed of a fluorescent colored injection molded material, and the pads are formed of a resilient compressible material to cushion dynamic impacts thereon.

20 Claims, 2 Drawing Sheets

BOAT BUMPER

TECHNICAL FIELD

The present invention relates generally to bumpers for cushioning the contact of a boat with a dock or boat lift, and more particularly to an improved boat bumper which is easily connected and disconnected from the boat, and highly durable.

BACKGROUND OF THE INVENTION

Various cushions and the like have been utilized in the prior art for protecting the sides of boats from docks, and for protecting the keel of a boat in case of contact with the ground. However, neither of these devices provide adequate protection for the bow of the boat as the boat is stored on a boat lift or trailer.

Typically, prior art cushions are cylindrical-shaped buoys attached to a rope, the buoy hung over the side of the boat to provide a cushion between the boat side and a dock or wharf. While such buoys are effective for their design purpose, they are not effectively positionable along the bow edge of the boat to protect this portion of the boat during storage of the boat on a lift or the like. In addition, it is necessary to store the buoy on the interior of the boat when not in use, thereby reducing space on the boat for passengers.

The prior art also discloses strips of rubber or other material which may be mounted along the length of the keel of the boat, to protect the keel when the boat is beached or otherwise contacts the ground. Again, while such strips are effective for their designed purposes, it is not easily detachable or replaced, nor is it specifically designed to cushion the bow of the boat against repeated contacts with a steel bar or the like utilized on boat lifts.

SUMMARY OF THE INVENTION

It is therefore a general object of the present invention to provide an improved boat bumper for the bow of a boat.

A further object is to provide a boat bumper which is easily connected and disconnected from the bow of a boat.

Still another object of the present invention is to provide an improved boat bumper which is of high strength for protecting against repeated contacts with steel posts and the like, yet has padded cushions for softening the blow against the boat bow.

Yet a further object is to provide a boat bumper which permits attachment of a tow rope or other connector to tether the boat as desired.

Still a further object of the present invention is to provide a boat bumper which is simple and economical to manufacture and easy to use.

These and other objects will be apparent to those skilled in the art.

The boat bumper of the present invention includes an elongated pipe encased in an injection molded material and having a pair of elongated spaced apart pads affixed to a rearward side of the body. Each pad has a generally V-shaped notch formed therein for receiving the bow edge of a boat. A bracket has a head portion extending around the pipe and is located between the two pads, the bracket having a pair of legs projecting rearwardly outwardly through the casing, to receive the eye on the bow of a boat therebetween. A ring is mounted on the bracket and projects diametric to the legs through the casing and forwardly from the body. The casing is formed of an injection molded material, and the pads are formed of a resilient compressible material to cushion dynamic impacts thereon.

DESCRIPTION OF THE PREFERRED EMBODIMENT

Figure 1:
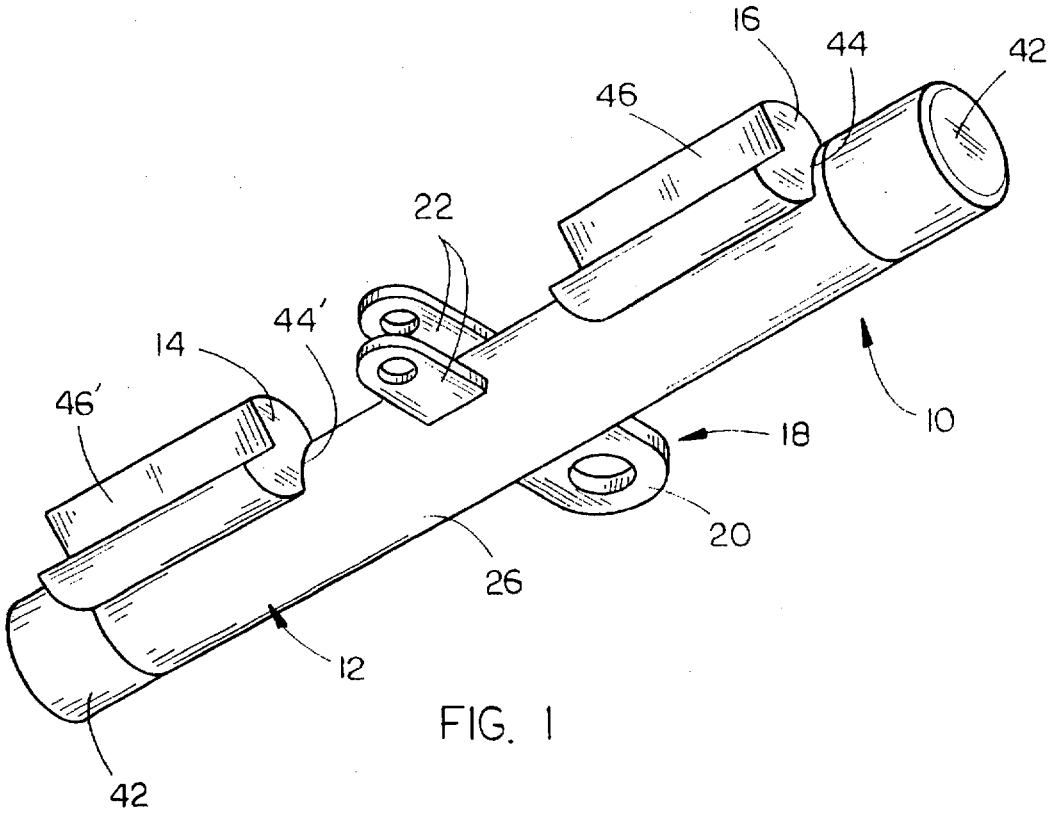
FIG. 1 is an enlarged perspective view of the boat bumper of the present invention.

Referring now to the drawings, in which similar or corresponding parts are identified with the same reference numeral and more particularly to FIG. 1, the boat bumper of the present invention is designated generally at 10 and includes an elongated cylindrical body 12 with a pair of resilient pads 14 and 16 attached to one side of body 12 for contact with the bow of a boat. An attachment bracket 18 includes a ring 20 which projects forwardly diametric to pads 14 and 16, and rearwardly projecting legs 22 longitudinally aligned with pads 14 and 16.

Figure 3:
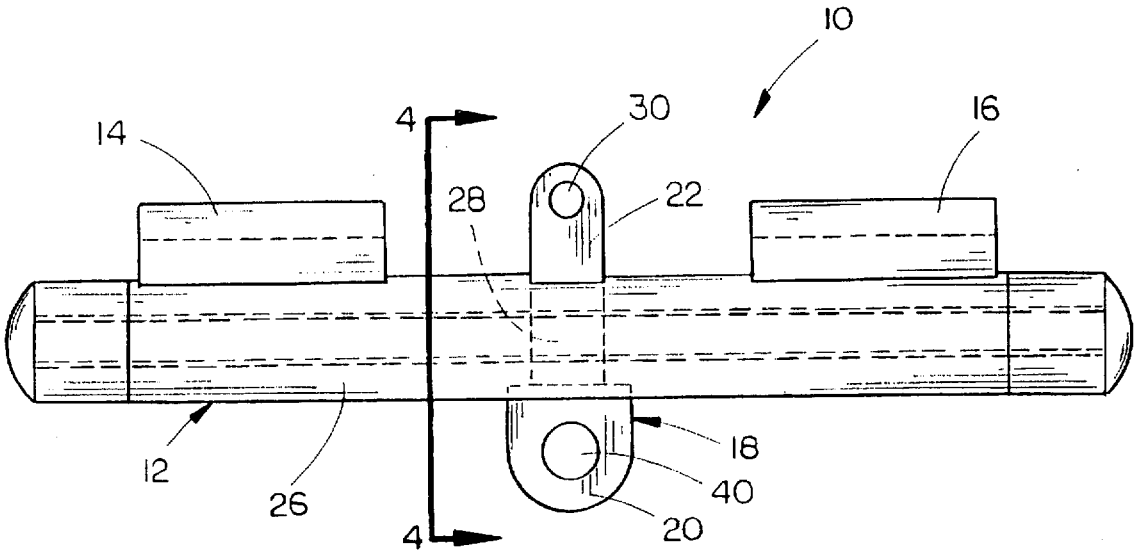
FIG. 3 is a side elevational view of the boat bumper.
Figure 4:
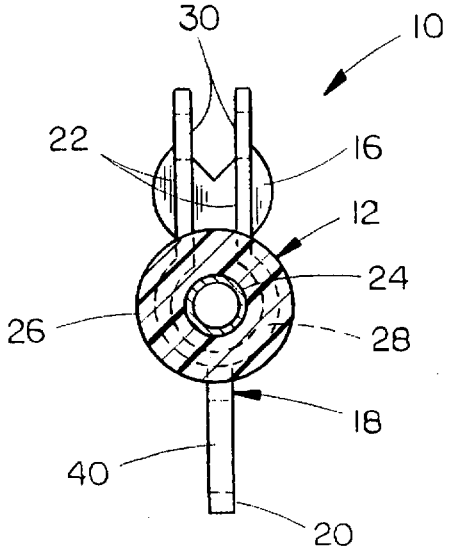
FIG. 4 is a sectional view taken at lines 4—4 in FIG. 3.

Referring now to FIGS. 3 and 4, it can be seen that body 12 includes a core formed of a stainless steel pipe 24 extending the length of body 12. Pipe 24 is completely coated with an injection molded material to form a cylindrical molded casing 26 of a rigid yet resilient material such as plastic. Preferably a fluorescent color is added to the molded material prior to molding, so that casing 26 will reflect light and "glow" at night. While orange is the preferred color as a warning indicator, other colors may be used.

As shown in FIG. 4, bracket legs 22 are connected together at their forward ends at a head portion 28. Head portion 28 extends around the diameter of pipe 24, and preferably has an annular shape and is located concentric to and spaced outwardly from pipe 24 such that molded casing 26 affixes head portion 28 in position on pipe 24.

Figure 2:
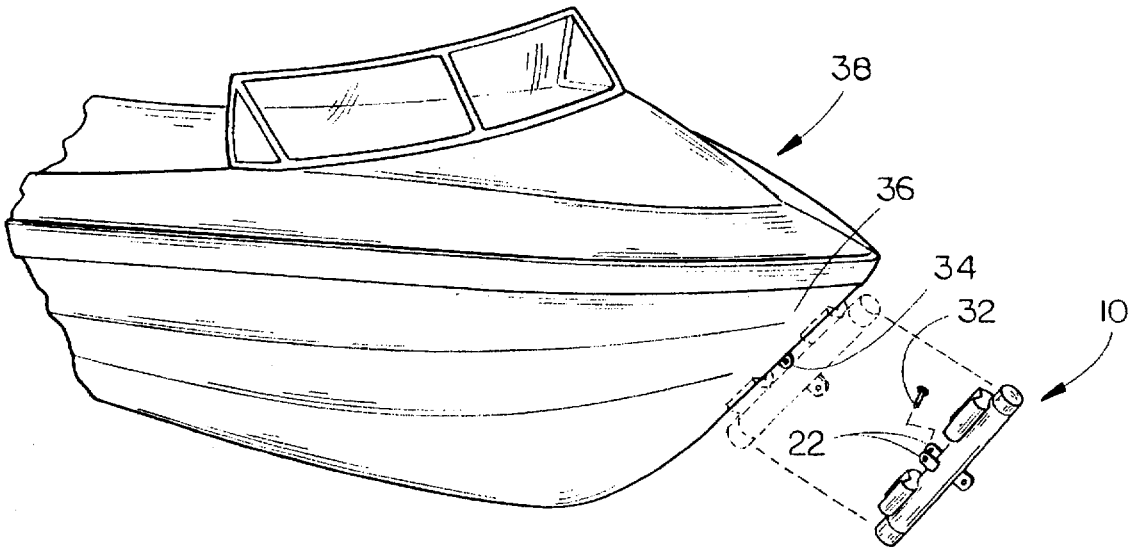
FIG. 2 is a perspective view showing the boat bumper spaced away from the bow of a boat.

Legs 22 project rearwardly out of casing 26, parallel to one another, and have a pair of aligned apertures 30 which will receive a locking pin 32 (shown in FIG. 2). Legs 22 are spaced apart a distance to receive the eye 34 on the bow 36 of boat 38 therebetween. Locking pin 32 will thereby selectively connect boat bumper 10 to boat 38 by connecting legs 22 to eye 34.

Referring once again to FIGS. 3 and 4, ring 20 is affixed to head portion 28 so as to project forwardly through casing 26, parallel and diametric to legs 22. Ring 20 includes an opening 40 therein for receiving a hook or rope to tether boat 38 to a trailer, lift or other apparatus.

A pair of molded end caps 42 are mounted to each end of body 12, as shown in FIG. 1. End caps 42 protect the ends of pipe 24 (not shown in FIG. 1) from weather and the elements.

Pads 14 and 16 are generally cylindrical in shape, and are affixed to the exterior of casing 26 on body 12 on opposite sides of legs 22. Pad 16 includes an arcuate groove 44 formed along its length and having a radius matching that of the casing 26, for a flush mounting thereon. A V-shaped notch 46 is formed in pad 16 and extends the length thereof, diametric to groove 44, and is formed to receive the bow edge of boat 36. Preferably, notch 46 extends through a 90° arc. Pad 14 includes a similar groove 44' and notch 46', as shown in FIG. 1. Preferably, pads 14 and 16 are formed of a closed cell resilient foam material to cushion contact of bumper 10 against the bow of boat 38.

Whereas the boat bumper of the present invention has been shown and described in connection with the preferred embodiment thereof, many modifications, substitutions and additions may be made which are within the intended broad scope of the appended claims.

I claim:

1. A boat bumper, comprising:

an elongated body having first and second ends and forward and rearward sides; first and second pads mounted on the rearward side of the body and spaced apart from one another;

each said pad having a notch formed along a length thereof, diametric to the body on each pad, said pad notches being aligned with one another; and a bracket mounted to said body between said pads, said bracket having first means for connecting the bracket to an eye on a bow of a boat.

2. The boat bumper of claim 1, wherein said body includes an elongated pipe forming a core and a casing extending around the pipe and along a length thereof, said casing formed of a material different than the pipe.

3. The boat bumper of claim 2, wherein the pipe is metal and the casing is a plastic material.

4. The boat bumper of claim 3, wherein said first connecting means includes a pair of legs projecting rearwardly from the body, said legs spaced apart from one another and each having an aperture therein aligned with the other leg aperture.

5. The boat bumper of claim 4, wherein said legs are connected together at a head portion, the head portion extending around the pipe and encased within the casing.

6. The boat bumper of claim 5, wherein said head portion is generally annular, concentric to the pipe and spaced outwardly from the pipe, with the casing formed between the head portion and pipe and also covering the head portion to affix the head portion and bracket in position on the pipe.

7. The boat bumper of claim 6, wherein said casing is injection molded on said pipe.

8. The boat bumper of claim 7, wherein said casing is formed of a material having a fluorescent color molded therein.

9. The boat bumper of claim 8, wherein said pads are formed of a resilient, compressible material, to cushion dynamic impacts thereto.

10. The boat bumper of claim 9, wherein said pads are formed of a closed-cell foam material.

11. The boat bumper of claim 10, wherein each pad is generally cylindrical in shape, each notch being generally V-shaped and extending an entire length of each pad.

12. The boat bumper of claim 11, wherein the body is generally cylindrical in shape and each pad has an arcuate groove extending the length of each pad diametric to each notch, each groove having a radius matching the radius of the body for a flush fit thereon.

13. The boat bumper of claim 12, further comprising a ring mounted on the body generally opposite said legs and projecting forwardly from the forward side of the body.

14. The boat bumper of claim 13, wherein said ring is affixed to the head portion of the bracket and projects outwardly through the casing.

15. The boat bumper of claim 1, wherein said first connecting means includes a pair of legs projecting rearwardly from the body, said legs spaced apart from one another and each having an aperture therein aligned with the other leg aperture.

16. The boat bumper of claim 15, wherein said legs are connected together at a head portion, the head portion extending around the pipe and encased within the casing.

17. The boat bumper of claim 16, wherein said head portion is generally annular, concentric to the pipe and spaced outwardly from the pipe, with the casing formed between the head portion and pipe and also covering the head portion to affix the head portion and bracket in position on the pipe.

18. The boat bumper of claim 1, wherein each pad is generally cylindrical in shape, each notch being generally V-shaped and extending an entire length of each pad.

19. The boat bumper of claim 1, wherein the body is generally cylindrical in shape and each pad has an arcuate groove extending the length of each pad diametric to each notch, each groove having a radius matching the radius of the body for a flush fit thereon.

20. The boat bumper of claim 1, further comprising a ring mounted on the body generally opposite said legs and projecting forwardly from the forward side of the body.

* * * * *